US005691097A

United States Patent [19]

Bortfeldt

[11] Patent Number: 5,691,097

[45] Date of Patent: Nov. 25, 1997

[54] TONER COMPOSITIONS

[75] Inventor: Janet M. Bortfeldt, Rochester, N.Y.

[73] Assignee: Xerox Corporation, Stamford, Conn.

[21] Appl. No.: 742,022

[22] Filed: Nov. 1, 1996

[51] Int. Cl.[6] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 3,590,000 | 6/1971 | Palermiti et al. | 430/110 |
| 3,900,588 | 8/1975 | Fisher | 430/110 |
| 4,433,040 | 2/1984 | Niimura et al. | 430/109 |
| 4,618,556 | 10/1986 | Takenouchi | 430/110 |
| 4,868,084 | 9/1989 | Uchide et al. | 430/110 |
| 5,340,678 | 8/1994 | Suzuki et al. | 430/110 |
| 5,447,815 | 9/1995 | Kato et al. | 430/110 |

*Primary Examiner*—Roland Martin
*Attorney, Agent, or Firm*—E. O. Palazzo

[57] ABSTRACT

A toner composition comprised of resin, pigment particles, wax, and a surface additive of silica treated with a dimethyl silicone fluid.

20 Claims, No Drawings

TONER COMPOSITIONS

BACKGROUND OF THE INVENTION

The present invention is generally directed to toner and developer compositions, and more specifically, the present invention is directed to negatively charged toner compositions, or toner particles containing certain silica surface additives, and more specifically TS-720, a treated fumed silica available from Cabot Corporation, and which silica is of a high purity, for example about 99.9 percent, and which is silica treated with a dimethyl silicone fluid. With the toners of the present invention, in embodiments thereof a number of advantages are achievable, such as excellent toner flow characteristics, such as a toner cohesivity of from about 3 to about 15, and more specifically, from about 5 to about 10 percent, especially as compared to toners with surface additives of AEROSIL R972® available from Cabot Corporation, and wherein there is enabled developed images, especially xerographic images with acceptable print quality, minimal or no print deletions, minimal or no flow related print deletions, and minimized photoreceptor filming. In embodiments of the present invention, the TS-720 is selected in certain important amounts, such as about 1 weight percent, and more specifically, from about 0.90 to about 0.95, and yet more specifically, from about 0.86 to about 0.91 weight percent. The aforementioned toner compositions can contain pigment particles comprised of, for example, carbon black, magnetites, or mixtures thereof, cyan, magenta, yellow, blue, green, red, or brown components, or mixtures thereof, and preferably magnetite, thereby providing for the development and generation of black and/or colored images, and in embodiments single component development wherein a carrier or carrier particles are avoided. The toner and developer compositions of the present invention can be selected for electrophotographic, especially xerographic, imaging and printing processes, including color processes.

Toner compositions with certain surface additives, including certain silicas, are known. Examples of these additives include colloidal silicas, such as certain AEROSILS like R972® available from Degussa, metal salts and metal salts of fatty acids inclusive of zinc stearate, aluminum oxides, cerium oxides, and mixtures thereof, which additives are generally present in an amount of from about 1 percent by weight to about 5 percent by weight, and preferably in an amount of from about 1 percent by weight to about 3 percent by weight. Several of the aforementioned additives are illustrated in U.S. Pat. Nos. 3,590,000 and 3,800,588, the disclosures of which are totally incorporated herein by reference.

Developer compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties, such as halides, phosphates, acetates, nitrates, benzoates, methylsulfates, perchloride, tetrafluoroborate, benzene sulfonate, and the like; U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide, reference the Abstract of the Disclosure and column 3; and a similar teaching is presented in U.S. Pat. No. 4,312,933, which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. No. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

SUMMARY OF THE INVENTION

Examples of objects of the present invention in embodiments thereof include:

It is an object of the present invention to provide toner and developer compositions with certain surface additives, and wherein the toners possess a number of advantages.

In another object of the present invention there are provided positively charged single component toner compositions useful for the development of electrostatic latent images including color images.

In yet another object of the present invention there are provided positively charged single component toner compositions containing as surface additives a treated fumed silica TS-720, available from Cabot Corporation as CAB-O-SIL® TS-720, and which silica has been treated with a dimethyl siloxane polymer, and wherein the resulting toner possesses improved flow characteristics, and enables developed images of excellent quality.

In yet a further object of the present invention there are provided humidity insensitive, from about, for example, 20 to 80 percent relative humidity at temperatures of from 60° to 80° F. as determined in a relative humidity testing chamber, positively charged toner compositions with desirable admix properties of 5 seconds to 60 seconds as determined by the charge spectrograph, and preferably less than 15 seconds for example, and more preferably from about 1 to about 14 seconds, and acceptable triboelectric charging characteristics of from about 10 to about 40 microcoulombs per gram.

Another object of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

The toner compositions in embodiments are comprised of resin particles, pigment particles, and surface additives of certain silicas. More specifically, the present invention in embodiments is directed to toner compositions comprised of resin, pigment, especially a magnetite, wax, especially a low molecular weight wax, such as a wax with a molecular weight of from about 1,000 to about 20,000, or from about 1,000 to about 10,000, like polypropylene wax 660P available from Sanyo Kasei Kogyo, charge additive and a surface additive comprised of the treated silica TS-720®.

The treated silica surface additive, which is a fluffy white powder, preferably has a bulk density of 3.0 pounds/ft.$^3$, a surface area, BET ($m^2/g$) of from about 80 to about 120, a carbon weight percent of from about 4.5 to about 6.1 percent, a size diameter of from about 15 to about 40, and preferably about 17 nanometers, and wherein during the manufacture thereof there results a silica with the surface completely coated with a dimethyl silicone fluid treating agent, and wherein the silicone fluid reacts with the silica surface hydroxyl groups thereby enabling a conversion of the silica from being hydrophilic to extremely hydrophobic. The treated silica TS-720®, which is specifically illustrated in Cabot Technical Data sheets of Jul. 18, 1996 entitled CAB-O-SIL® TS-720, Treated Fumed Silica, and CAB-O-SIL® TS-720, Hydrophobic Fumed Silica, the disclosures of each of these sheets being totally incorporated herein by reference, and a copy of these sheets being included with the mailing of the present application, is selected in various effective amounts, and more specifically, in the amounts indicated herein, such as less than or equal to about 1 weight percent.

The toner compositions of the present invention can be prepared by admixing and heating resin particles such as styrene polymers, polyesters, and similar thermoplastic resins, pigment particles such as magnetite, wax, especially low molecular weight waxes, and charge enhancing additives, or mixtures of charge additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Thereafter, the TS-720® silica is added by the blending thereof with the toner obtained.

Illustrative examples of suitable toner resins, especially thermoplastic resins, include polyamides, polyolefins, styrene acrylates, such as PSB-2700 obtained from Hercules-Sanyo Inc., and preferably selected in the amount of about 57 percent, styrene methacrylate, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers, may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; Pliolites; suspension polymerized styrene butadienes, reference U.S. Pat. No. 4,558, 108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 1,000 to about 20,000, such as polyethylene, polypropylene, and paraffin waxes, can be included in, or on the toner compositions as fuser roll release agents. The resin is present in a sufficient, but effective amount, for example from about 50 to about 90 weight percent.

Magnetites are known and include a mixture of iron oxides ($FeO.Fe_2O_3$), including those commercially available as MAPICO BLACK™, and are present in the toner composition in various effective amounts, such as an amount of from about 10 percent by weight to about 75 percent by weight, and preferably in an amount of from about 30 percent by weight to about 55 percent by weight.

There can be included in the toner compositions of the present invention charge additives as indicated herein in various effective amounts, such as from about 1 to about 19, and preferably from about 1 to about 3 weight percent, and waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K.K., and the like. The commercially available polyethylenes selected have a molecular weight of from about 1,000 to about 1,500, while the commercially available polypropylenes utilized are believed to have a molecular weight of from about 4,000 to about 7,000. Many of the polyethylene and polypropylene compositions useful in the present invention are illustrated in British Patent No. 1,442,835, the disclosure of which is totally incorporated herein by reference. The wax is present in the toner composition of the present invention in various amounts, however, generally these waxes are present in the toner composition in an amount of from about 1 percent by weight to about 15 percent by weight, and preferably in an amount of from about 2 percent by weight to about 10 percent by weight. The toners of the present invention may also in embodiments thereof contain polymeric alcohols, such as UNILINS®, reference U.S. Pat. No. 4,883,736, the disclosure of which is totally incorporated herein by reference, and which UNILINS® are available from Petrolite Corporation.

The processes of the present invention are as illustrated herein and comprise the admixing of the toner components with heating, followed by cooling, and classification. With these processes, there are enabled toners with excellent and improved flow characteristics. Moreover, the toners of the present invention can be selected for xerographic imaging and printing systems, such as the Xerox Corporation 4213, and wherein there are enabled excellent quality images, and the toner possesses improved flow characteristics. Improved toner flow prevents magnetic roll starvation and, therefore, the white streaking print defect. White streaking, or areas of nonprinting usually occurs when there is no toner on the magnetic roll to transfer to the photoreceptor. When the toner flows well, it flows readily and substantially completely to the magnetic roll. Flow in SCD (single component development) toners is important since there is no carrier to assist in movement of the toner to the roll.

Embodiments of the present invention include a toner composition comprised of resin, pigment particles, wax, and a surface additive of silica treated with a dimethyl silicone fluid; a negatively charged toner with excellent flow characteristics comprised of thermoplastic resin, magnetite, charge additive, wax, and a surface additive comprised of hydrophobic silica coated with a dimethyl silicone fluid; a toner with a cohesion value of from about 5 to about 10 percent; a toner wherein the silica is present in an amount of from about 0.80 to about 0.95 weight percent; a toner wherein the silica is present in an amount of from about 0.90 to about 0.95 weight percent; a toner wherein the silica is of a size diameter of from about 15 to about 40 nanometers; a toner wherein the magnetite is present in an amount of from about 20 to about 75 weight percent; a toner wherein the resin is styrene n-butylacrylate present in an amount of about 56.4 percent, the pigment is a magnetite present in an amount of about 39.7 percent, the wax is polypropylene, polyethylene, or mixtures thereof present in an amount of about 3 percent, the charge control is present in the amount of about 0.83 percent, and the external additive is the fumed silica TS-720® present in the amount of about 0.9 percent, and wherein the toner cohesion flow value of said toner is from about 5 to about 10 percent as measured with a Hosokawa Powders Tester; and a process for the preparation of toner with enhanced flowability which comprises admixing resin, charge additive, wax, and magnetite, and thereafter adding thereto a surface additive comprised of hydrophobic silica coated with a dimethyl silicone fluid.

The following Examples are provided.

EXAMPLE I

There was prepared in an extrusion device, available as ZSK-92 from Werner Pfleiderer, a toner composition by adding thereto 56.4 percent by weight of PSB-2700, a polymer generated by the copolymerization of styrene and n-butylacrylate and available from Sanyo Kasei Kogyo or Hercules-Sanyo, Inc.; 39.7 percent by weight of MB-22 or TMB-105T, a magnetite available from Titan Kogyo or Magnox, Inc.; 3.0 percent by weight of 660P, a polypropylene wax obtained from Sanyo Kasei Kogyo; and 0.83 percent by weight of TRH Aizon Spilon, believed to be (bis[1-[(3,5-disubstituted-2-hydroxyphenyl)azo]-3-(monosubstituted)-2-naphthalenolato (2-)]chromate (1-), ammonium sodium and hydrogen) a charge enhancing additive available from Hodogaya Chemicals.

The toner product was then extruded at a rate of 2,000 pounds per hour, reaching a melt temperature of about 340° F. The melt product exiting from the extruder was cooled to about 25° C. on a belt and then crushed into small particles. The resulting toner was subjected to grinding on an AFG micronizer enabling toner particles with a volume median diameter of from 9 to 13 microns as measured by a Coulter Counter. Thereafter, the aforementioned toner particles were classified in a Donaldson Model C classifier for the purpose of removing fines particles, that is, those with a volume median diameter of less than about four microns.

Subsequently, the above formulated toner, 100 parts by weight, was mixed with 0.90 percent by weight of TS-720®, a treated flow-enhancing external additive as obtained from Cabot Corporation. Mixing was accomplished using a vertical Henschel blender for twenty minutes. Subsequently, the toner was screened for the purposes of removing oversized and undesirable particles.

Toner flow performance was quantified using a Hosokawa Powders Tester, available from Micron Powders Systems, using a technique that measures the toner cohesivity. The cohesion is a quantifiable measure of the flow characteristics of a given material. The higher the cohesion value, the lesser the flowability of the toner. The maximum cohesion value is 100, the minimum (no flow) approaches zero.

Using this instrument, the above prepared toner evidenced a measurable improvement in cohesion value and thus flow, and more specifically, the measured cohesion value was from about 5 to about 10 percent. When this toner was utilized in a Xerox Corporation 4213 machine, no white streaking of the images was observed.

Toner prepared with the prior art fumed silica R-972®, 0.90 weight percent, as obtained from Degussa Inc. of Germany, in place of the TS-720® silica, exhibited certain print defects, such as white streaking, or areas of nonprinting when the toner was used in a Xerox Corporation 4123. The measured cohesion value for this toner with the R-972® was 30 to 40 percent.

Other modifications of the present invention may occur to one of ordinary skill in the art subsequent to a review of the present application, and these modifications, including equivalents thereof, are intended to be included within the scope of the present invention.

What is claimed is:

1. A process for the preparation of toner with enhanced flowability consisting essentially of admixing resin, charge additive, wax, and magnetite, and thereafter adding thereto a surface additive comprised of a hydrophobic silica coated with a dimethyl silicone fluid, and further wherein said surface additive possesses a surface area, BET of from about 80 to about 120 $m^2/g$, a carbon weight percent of from about 4.5 to about 6.1 percent, a size diameter of from about 15 to about 40 nanometers, and wherein said toner possesses a cohesivity of from about 3 to about 15 percent.

2. A process in accordance with claim 1 wherein the resin is a styrene polymer.

3. A process in accordance with claim 1 wherein the resin is a styrene acrylate, a styrene methacrylate, or a polyester.

4. A process in accordance with claim 1 wherein the resin is styrene butylacrylate.

5. A process in accordance with claim 1 wherein said toner cohesion value is from about 5 to about 10 percent.

6. A process in accordance with claim 1 wherein said hydrophobic silica is present in an amount of from about 0.80 to about 0.95 weight percent.

7. A process in accordance with claim 1 wherein said hydrophobic silica is present in an amount of from about 0.90 to about 0.95 weight percent.

8. A process in accordance with claim 1 wherein said hydrophobic silica is of a size diameter of from about 15 to about 40 nanometers.

9. A process in accordance with claim 1 wherein the resin is present in an amount of from about 70 to about 90 weight percent, and the wax is of a molecular weight $M_w$ of from about 1,000 to about 20,000.

10. A process in accordance with claim 1 containing less than about 1 weight percent of said silica.

11. A process in accordance with claim 1 wherein the magnetite is present in an amount of from about 20 to about 75 weight percent.

12. A process in accordance with claim 1 wherein the magnetite is present in an amount of from about 30 to about 55 weight percent.

13. A process in accordance with claim 1 wherein the resin is styrene n-butylacrylate present in an amount of about 56.4 percent, the magnetite is present in an amount of about 39.7 percent, the wax is polypropylene, polyethylene, or mixtures thereof present in an amount of about 3 percent, the charge control is present in the amount of about 0.83 percent, and said silica surface additive is present in the amount of about 0.9 percent, and wherein the toner cohesion flow value of said toner is from about 5 to about 10 percent as measured with a Hosokawa Powders Tester.

14. A process in accordance with claim 1 wherein the charge additive is present in an amount of from about 0.05 to about 5 weight percent, or is present in an amount of from about 0.1 to about 3 weight percent.

15. A process in accordance with claim 1 wherein said toner possesses an admix time of from less than about 15 seconds, or an admix time of from about 1 to about 14 seconds.

16. A process in accordance with claim 1 wherein said toner possesses a negative triboelectric charge of from about 10 to about 40 microcoulombs per gram.

17. A process in accordance with claim 1 wherein said wax component possesses a molecular weight of from about 1,000 to about 20,000.

18. A process in accordance with claim 1 wherein the wax is selected from the group consisting of polyethylene and polypropylene.

19. A process in accordance with claim 1 wherein the charge additive is bis[1-3-(mono-substituted)-2-naphthalenolato (2-)]chromate (1-), ammonium sodium and hydrogen (TRH), Aizon Spilon.

20. A process for the preparation of toner with enhanced flowability consisting of admixing resin, charge additive, wax, and magnetite, and thereafter adding thereto a surface additive comprised of a hydrophobic silica coated with a dimethyl silicone fluid, and further wherein said surface additive possesses a surface area, BET of from about 80 to about 120 $m^2/g$, a carbon weight percent of from about 4.5 to about 6.1 percent, a size diameter of from about 15 to about 40 nanometers, and wherein said toner possesses a cohesivity of from about 3 to about 15 percent.

* * * * *